US010446997B2

(12) United States Patent
Miyakawa et al.

(10) Patent No.: US 10,446,997 B2
(45) Date of Patent: Oct. 15, 2019

(54) METHOD FOR MANUFACTURING TERMINAL WITH ELECTRIC WIRE

(71) Applicant: YAZAKI CORPORATION, Tokyo (JP)

(72) Inventors: Daisuke Miyakawa, Shizuoka (JP); Tomonori Kawakami, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 246 days.

(21) Appl. No.: 15/385,149

(22) Filed: Dec. 20, 2016

(65) Prior Publication Data

US 2017/0179664 A1 Jun. 22, 2017

(30) Foreign Application Priority Data

Dec. 22, 2015 (JP) ..... 2015-249462

(51) Int. Cl.
*H01R 43/05* (2006.01)
*B05D 3/06* (2006.01)
(Continued)

(52) U.S. Cl.
CPC ..... *H01R 43/05* (2013.01); *B05D 3/067* (2013.01); *B05D 7/14* (2013.01); *H01R 4/185* (2013.01);
(Continued)

(58) Field of Classification Search
CPC ..... B05D 3/067; B05D 7/14; H01R 13/5216; H01R 2101/00; H01R 43/005; H01R 43/05; H01R 43/24
See application file for complete search history.

(56) References Cited

U.S. PATENT DOCUMENTS 7,638,780 B2 * 12/2009 Kilburn ..... F26B 3/28 118/620
8,266,798 B2 * 9/2012 Martauz ..... H01R 4/184 29/852
(Continued)

FOREIGN PATENT DOCUMENTS

CN 104936999 A 9/2015
CN 106065208 A 11/2016
(Continued)

OTHER PUBLICATIONS

Chinese Office Action for the related Chinese Patent Application No. 201611198680.8 dated Jul. 4, 2018.
(Continued)

*Primary Examiner* — Minh N Trinh
(74) *Attorney, Agent, or Firm* — Kenealy Vaidya LLP

(57) ABSTRACT

A method for manufacturing a terminal with an electric wire includes: forming a conductor exposed portion by removing a resin coating of an electric wire; forming a wire-terminal connection portion by connecting a terminal fitting to a position of the conductor exposed portion; supplying a sealing material made of ultraviolet-curing resin from a nozzle to form a sealing portion covering the wire-terminal connection portion; and curing the sealing material by irradiation with ultraviolet rays from a UV light. During curing of the sealing material, a reflector is used to allow the ultraviolet rays to be reflected toward the sealing material supplied to the wire-terminal connection portion.

2 Claims, 9 Drawing Sheets

(51) Int. Cl.

| | |
|---|---|
| ***B05D 7/14*** | (2006.01) |
| ***H01R 4/18*** | (2006.01) |
| ***H01R 13/52*** | (2006.01) |
| ***H01R 43/24*** | (2006.01) |
| ***H01R 43/00*** | (2006.01) |
| ***H01R 101/00*** | (2006.01) |
| ***H01R 4/62*** | (2006.01) |
| ***H01R 43/28*** | (2006.01) |

(52) U.S. Cl.
CPC ..... *H01R 13/5216* (2013.01); *H01R 43/005* (2013.01); *H01R 43/24* (2013.01); *H01R 4/62* (2013.01); *H01R 43/28* (2013.01); *H01R 2101/00* (2013.01)

(56) References Cited

U.S. PATENT DOCUMENTS

2015/0140202 A1* 5/2015 Sato ..... H01R 4/185 427/58
2015/0287496 A1* 10/2015 Sato ..... H01R 4/62 174/74 R
2015/0340848 A1 11/2015 Nakashima et al.
2016/0308301 A1 10/2016 Mano
2017/0162997 A1* 6/2017 Miyakawa ..... H01R 4/183

FOREIGN PATENT DOCUMENTS

| | | | |
|---|---|---|---|
| CN | 106252918 | A | 12/2016 |
| JP | 2008-124024 | A | 5/2008 |
| JP | 2011-113708 | A | 6/2011 |
| JP | 2011-142004 | A | 7/2011 |
| JP | 5137977 | B2 | 2/2013 |
| JP | 2014-203725 | A | 10/2014 |

OTHER PUBLICATIONS

Japanese Office Action for the related Japanese Patent Application No. 2015-249463 dated Apr. 3, 2018.

* cited by examiner

METHOD FOR MANUFACTURING TERMINAL WITH ELECTRIC WIRE

CROSS-REFERENCE TO RELATED APPLICATION(S)

This application is based on and claims priority from Japanese Patent Application (Application No. 2015-249462) filed on Dec. 22, 2015, the entire contents of which are incorporated herein by reference.

BACKGROUND

1. Field of the Invention

The present invention relates to a method for manufacturing a terminal with an electric wire, in which a sealing portion such as an anticorrosion portion is formed in a connection part where different kinds of metals are connected to each other between the electric wire and a terminal fitting.

2. Description of Related Art

A wire harness is wired in a vehicle, for example, in order to establish electric connection between devices mounted on a car. The wire harness is configured to include an electric wire bundle, and various connectors disposed at terminal ends of the electric wire bundle. Each connector for the wire harness is configured to include an insulating connector housing, and a plurality of conductive terminal fittings received in terminal reception chambers of the connector housing. The terminal fittings are disposed at terminal ends of electric wires constituting the electric wire bundle. Copper electric wires (whose conductors consist of stranded wires made of copper or a copper alloy) are generally used as the electric wires. The terminal fittings are crimped and connected to terminal ends of the copper electric wires from which coatings have been removed. Incidentally, a base material of the terminal fittings is made of copper or a copper alloy in the same manner as the conductors of the copper electric wires. Plating may be applied to the terminal fittings.

In recent years, aluminum electric wires (electric wires whose conductors are made of aluminum or an aluminum alloy are referred to as aluminum electric wires herein) may be used in place of copper electric wires in consideration of weight reduction of a vehicle and easiness in recycling materials as well as shortage of copper resources. However, it has been known that an oxide film formed in the surface of an aluminum electric wire is thicker than that in the surface of a copper electric wire whose conductor is made of copper, and contact resistance between a conductor of the aluminum electric wire and a terminal fitting (crimping terminal) is apt to be comparatively higher. Therefore, in order to reduce the contact resistance between the conductor of the aluminum electric wire and the crimping terminal, the following method is used. That is, a pair of conductor crimping pieces are formed in the crimping terminal, and the conductor is strongly crimped by the conductor crimping pieces to increase a compression rate. According to this method, the conductor of the aluminum electric wire is strongly crimped so that an oxide film on each of strands constituting the conductor can be broken. That is, the contact resistance between the conductor and the crimping terminal can be reduced.

However, it has been known that when water intervenes in a contact part between an aluminum material and a copper material or, to say other words, in a contact part between different kinds of metals, both the metals, that is, aluminum and copper are dissolved into the water as ions so that electric corrosion can occur due to a potential difference or the like between the both. Incidentally, when a conductor of an aluminum electric wire and a crimping terminal made of copper or a copper alloy are electrically and mechanically connected to each other, the conductor is crimped with a high compression rate by conductor crimping pieces of the crimping terminal so that water immersion can be prevented in the crimping part where the conductor is crimped, with the result that occurrence of electric corrosion can be avoided. However, in a position in an axial direction of the terminal (in an extending direction of the electric wire) with respect to the crimping part where the conductor is crimped by the conductor crimping pieces, the conductor is exposed partially. Therefore, when water adhering to the exposed part of the conductor reaches the crimping part, the crimping part becomes a state as if it were immersed in an electrolytic solution. Thus, there is a fear that aluminum that is a metal having a higher ionization tendency may be dissolved to advance electric corrosion. As a solution, in order to prevent water from adhering to the exposed part of the conductor or from entering into the crimping part, an anticorrosion portion 115 (sealing portion) is formed in the background art as shown in FIGS. 9A and 9B (for example, see JP-A-2011-113708).

In FIGS. 9A and 9B, the reference numeral 101 represents an aluminum electric wire, and the reference numeral 102 represents a crimping terminal. The aluminum electric wire 101 is configured to include a conductor 103 made of aluminum or an aluminum alloy, and an insulating resin coating 104 covering the conductor 103. An end portion of the resin coating 104 is removed from the aluminum electric wire 101. Thus, a conductor exposed portion 105 is formed. On the other hand, the crimping terminal 102 is a female type terminal fitting, which is formed into the illustrated shape by pressing of a metal plate made of copper or a copper alloy. The crimping terminal 102 includes a rectangular cylindrical electric contact portion 106, a crimping portion 107, and a coupling portion 108 that couples the electric contact portion 106 and the crimping portion 107 with each other. A mounting portion 109, conductor crimping pieces 110 and coating crimping pieces 111 are formed in the crimping portion 107. The conductor exposed portion 105 is mounted on the mounting portion 109. The conductor exposed portion 105 mounted on the mounting portion 109 is crimped by the conductor crimping pieces 110. The resin coating 104 near the conductor exposed portion 105 is crimped by the coating crimping pieces 111.

In the above-described configuration and structure, a wire-terminal connection portion 118 is formed including a conductor crimping part 112 in which the conductor exposed portion 105 is crimped by the conductor crimping pieces 110, and a coating crimping part 113 in which the resin coating 104 near the conductor exposed portion 105 is crimped by the coating crimping pieces 111. Incidentally, in the conductor crimping part 112, a non-crimping part 114 is produced due to the relationship between the length of the conductor exposed portion 105 and the width of the conductor crimping pieces 110. Therefore, the anticorrosion portion 115 (sealing portion) is formed in the wire-terminal connection portion 118 so as to cover the non-crimping part 114. The anticorrosion portion 115 is formed of an anticorrosive material 117 (sealing material) dropping from respective nozzles 116 of two dispensers. The anticorrosive material 117 applied by dropping is then cured. Thus, the anticorrosion portion 115 is formed. Incidentally, silicone rubber is used as the anticorrosive material 117.

SUMMARY

In the background-art technique, there is a problem that it takes a considerable amount of time to cure the anticorrosive material 117. Therefore, the present inventor thought that an anticorrosive material (sealing material) made of ultraviolet-curing resin is used so that the anticorrosive material can be cured in a short time by energy caused by irradiation with ultraviolet rays from a UV light. However, it was found that, when the anticorrosive material is not surely irradiated with the ultraviolet rays, a part that has not been cured is generated to cause electric corrosion.

The present invention has been made in consideration of the above-described situation. An object of the invention is to provide a method for manufacturing a terminal with an electric wire, capable of surely curing a sealing material.

In a first aspect of the invention, there is provided a method for manufacturing a terminal with an electric wire including: forming a conductor exposed portion by removing a resin coating of an electric wire; forming a wire-terminal connection portion by connecting a terminal fitting to a position of the conductor exposed portion; supplying a sealing material made of ultraviolet-curing resin from a nozzle to form a sealing portion covering the wire-terminal connection portion; and curing the sealing material by irradiation with ultraviolet rays from a UV light, wherein during curing of the sealing material, a reflector is used to allow the ultraviolet rays to be reflected toward the sealing material supplied to the wire-terminal connection portion.

According to the first aspect of the invention, the sealing material supplied to the wire-terminal connection portion receives energy caused by irradiation with ultraviolet rays directly from the UV light and indirectly through the reflector. Thus, the sealing material can be cured in a short time. According to the first aspect of the invention, even when there is a part in the shade of the UV light, the part can be irradiated with ultraviolet rays indirectly through the reflector. Accordingly, there is no fear of a problem that the sealing material supplied to the wire-terminal connection portion cannot be cured.

In a second aspect of the invention, there is provided the method for manufacturing a terminal with an electric wire according to the first aspect, wherein during curing of the sealing material, the UV light and the reflector are disposed such that the irradiation with ultraviolet rays is performed on a whole circumference of the wire-terminal connection portion around an axis of the terminal fitting.

According to the second aspect of the invention, ultraviolet rays can be radiated all over the circumference around the axis of the terminal fitting. Thus, there is no fear that the sealing material supplied to the wire-terminal connection portion cannot be cured.

In the first aspect of the invention, the electric wire may be an aluminum electric wire, the terminal fitting may be made of a different kind of metal from the aluminum electric wire, the sealing material may bean anticorrosive material, and the sealing portion may be an anticorrosion portion. In this case, the method may be expressed as "a method for manufacturing a terminal with an electric wire including: forming a conductor exposed portion by removing an insulating resin coating of an electric wire including a conductor made of aluminum or an aluminum alloy and the resin coating covering the conductor; forming a wire-terminal connection portion by connecting a terminal fitting having a base material made of copper or a copper alloy to a position of the conductor exposed portion; supplying an anticorrosive material made of ultraviolet-curing resin from a nozzle to form an anticorrosion portion covering the wire-terminal connection portion; and curing the anticorrosive material by irradiation with ultraviolet rays from a UV light, wherein during curing of the anticorrosive material, a reflector is used to allow the ultraviolet rays to be reflected toward the anticorrosive material supplied to the wire-terminal connection portion.

Alternatively, in the first aspect of the invention, the sealing material may be a waterproofing material, and the sealing portion may be a waterproof portion. In this case, the method may be expressed as "a method for manufacturing a terminal with an electric wire including: forming a conductor exposed portion by removing a resin coating of an electric wire; forming a wire-terminal connection portion by connecting a terminal fitting to a position of the conductor exposed portion; supplying a waterproofing material made of ultraviolet-curing resin from a nozzle to form a waterproof portion covering the wire-terminal connection portion; and curing the waterproofing material by irradiation with ultraviolet rays from a UV light, wherein during curing of the waterproofing material, a reflector is used to allow the ultraviolet rays to be reflected toward the waterproofing material supplied to the wire-terminal connection portion."

According to the first or second aspect of the invention, there is an advantage that it is possible to surely cure a sealing material.

BRIEF DESCRIPTION OF THE DRAWINGS

FIGS. 9A and 9B are views of a terminal with an electric wire in a background-art example, in which FIG. 9A is a perspective view, and FIG. 9B is a sectional view taken on line D-D.

DETAILED DESCRIPTION

A terminal with an electric wire is configured to include an aluminum electric wire and a crimping terminal. The aluminum electric wire is configured to include a conductor made of aluminum or an aluminum alloy, and an insulating resin coating covering the conductor. The resin coating is removed from the aluminum electric wire to form a conductor exposed portion. The crimping terminal includes a crimping portion as a crimping part. Conductor crimping pieces and coating crimping pieces are formed in the crimping portion. In the terminal with the electric wire, the crimping portion is crimped to the conductor exposed portion to form a wire-terminal connection portion. Then, an anticorrosion portion is formed to cover the wire-terminal connection portion. The anticorrosion portion is formed in such a manner that a voltage is applied between the crimping terminal and a metal nozzle, and an anticorrosive material that has been charged is supplied from the metal nozzle so that the anticorrosive material can be attracted to the wire-terminal connection portion. In addition, the anticorrosion portion is formed in such a manner that the anticorrosive material supplied to the wire-terminal connection portion is irradiated with ultraviolet rays and UV-cured. In order to be UV-cured, the anticorrosive material is irradiated with ultraviolet rays directly from a UV light and indirectly through a reflector.

Figure 1:
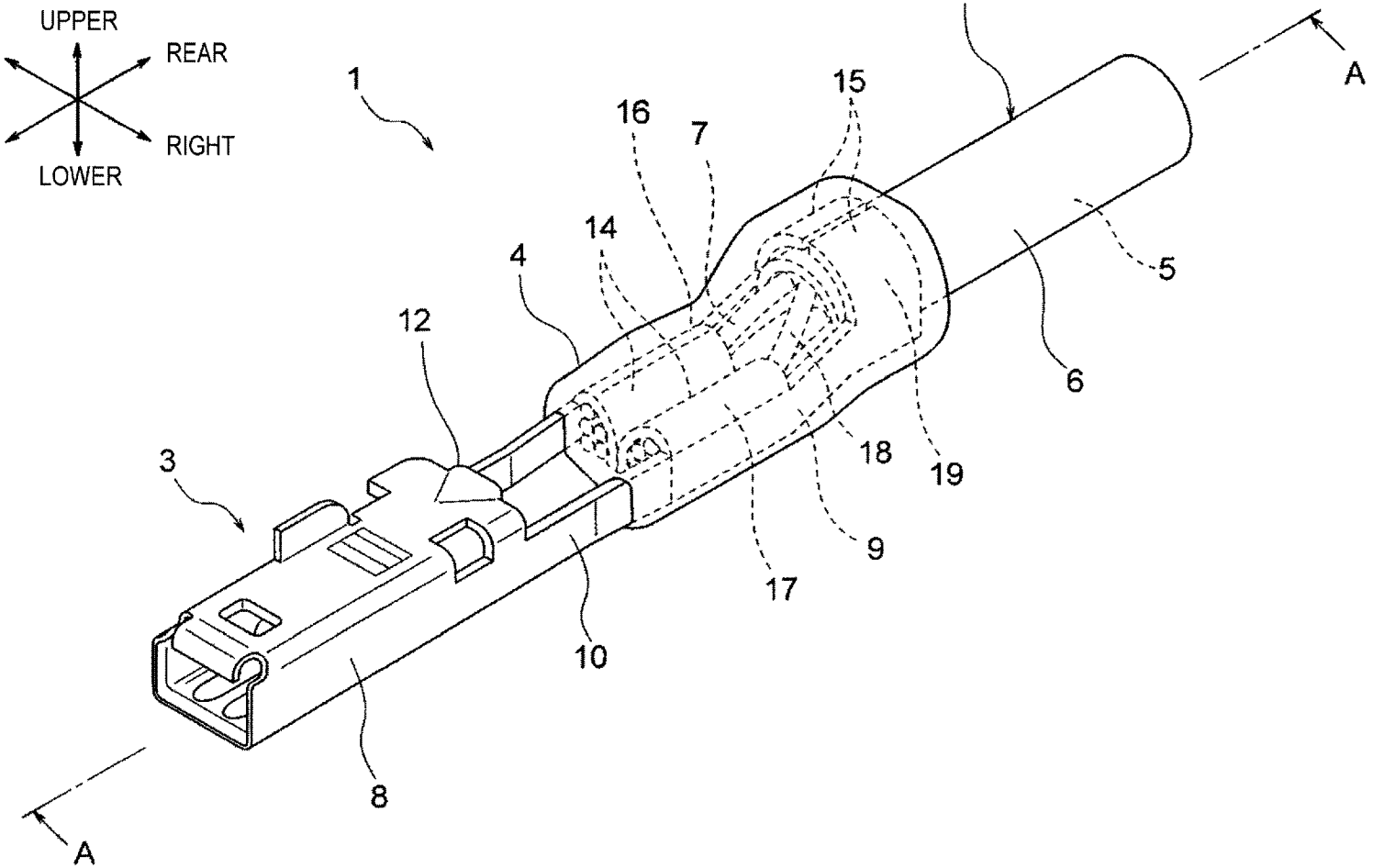
FIG. 1 is a perspective view showing a terminal with an electric wire, which is manufactured by a manufacturing method according to an embodiment of the invention.
Figure 2:
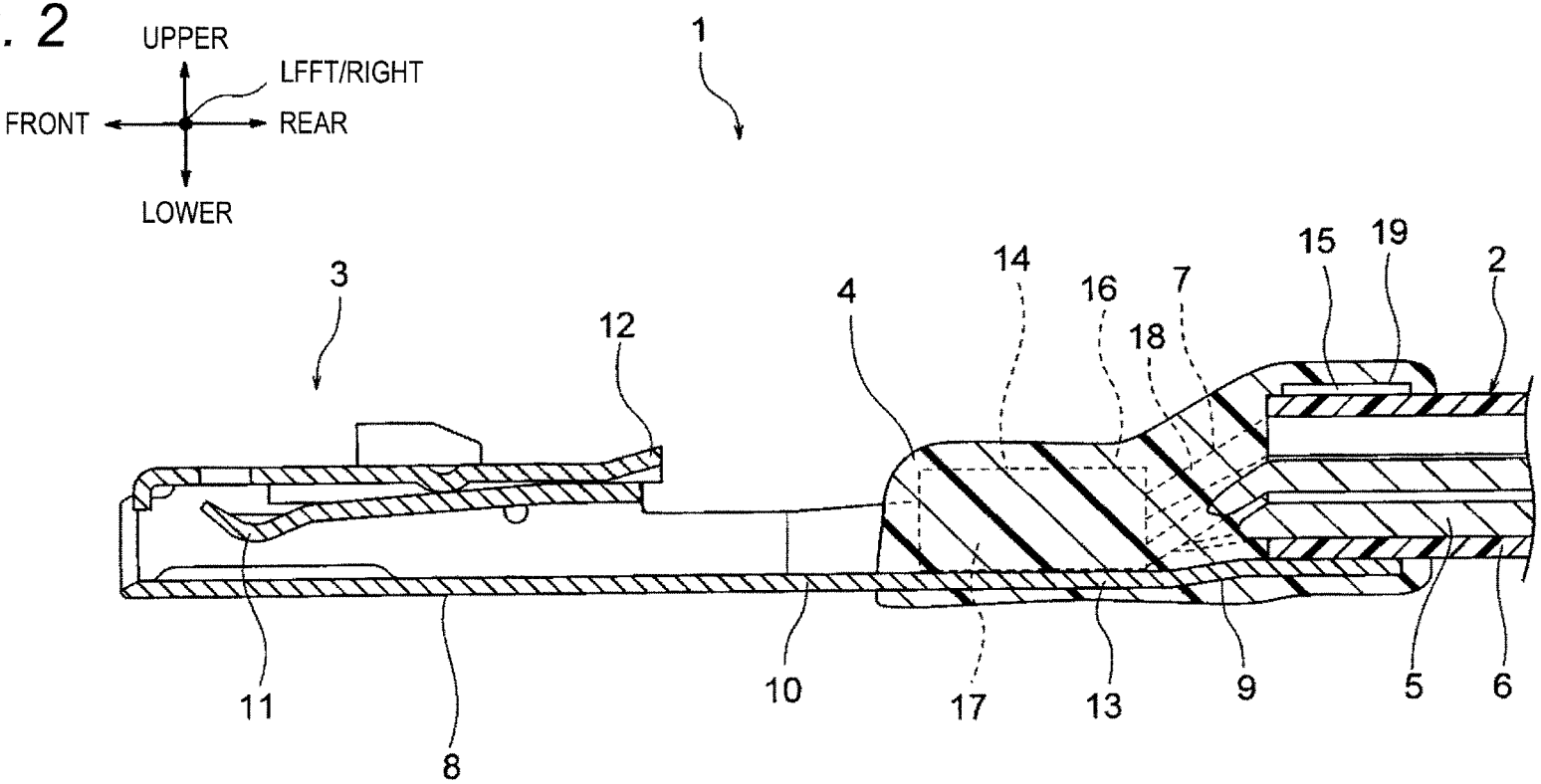
FIG. 2 is a sectional view taken on line A-A in FIG. 1.
Figure 3:
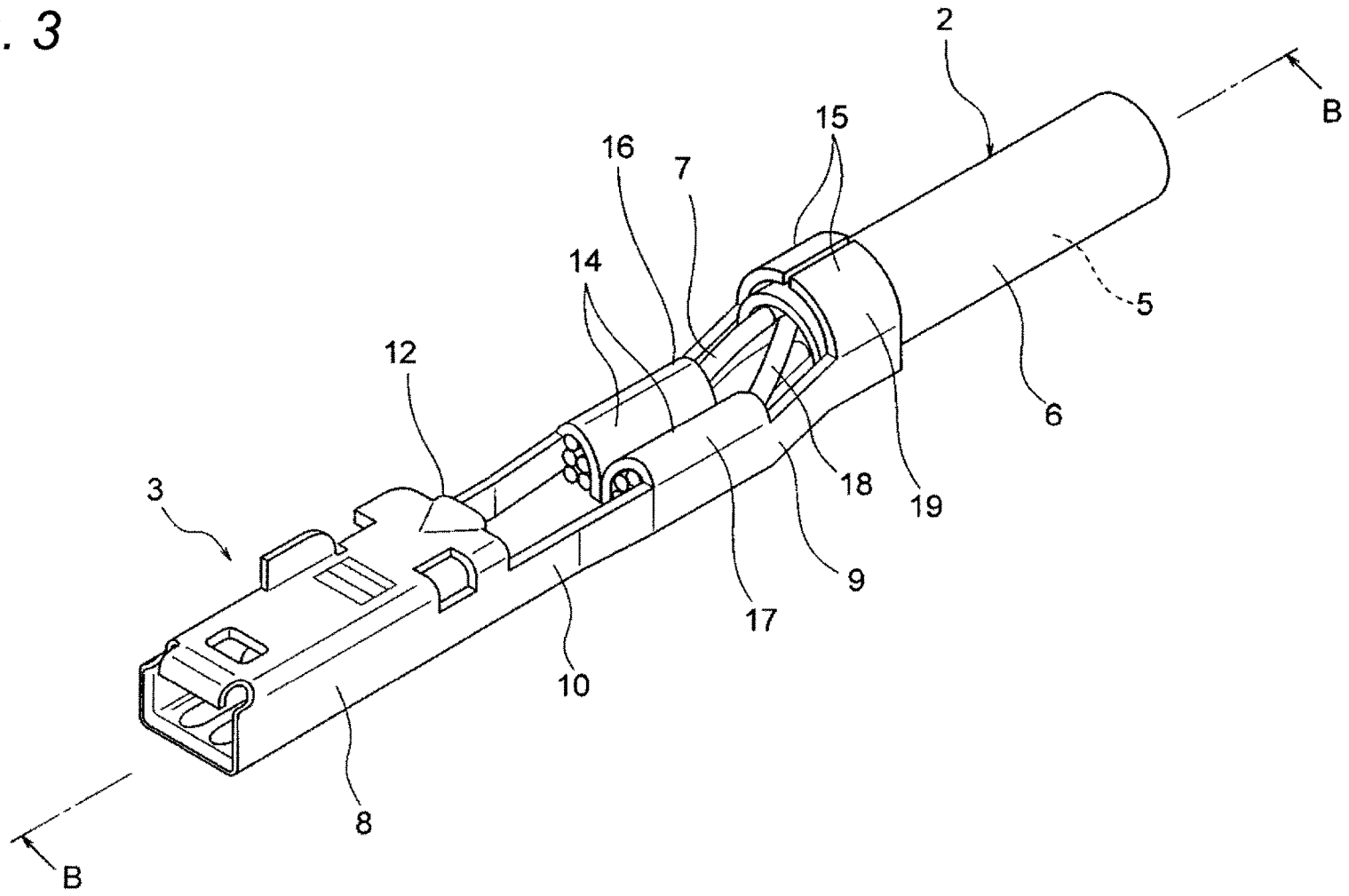
FIG. 3 is a perspective view showing a terminal with an electric wire, in which an anticorrosion portion has not been formed yet.
Figure 4:
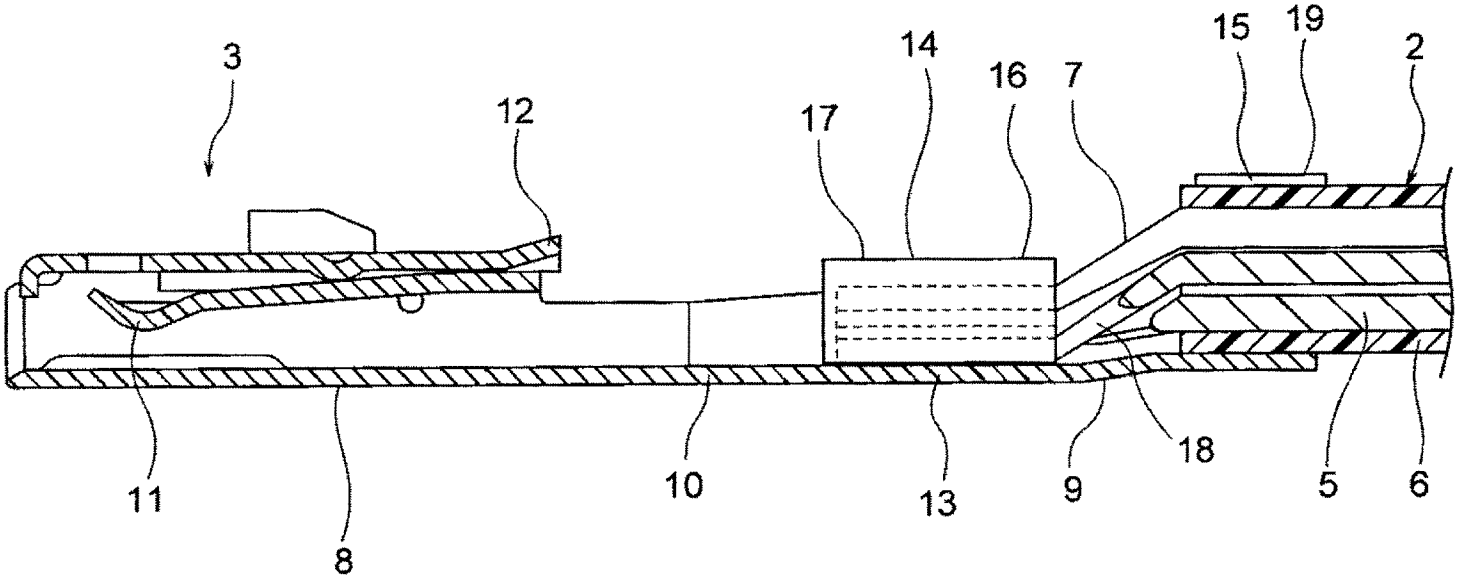
FIG. 4 is a sectional view taken on line B-B in FIG. 3.
Figure 5:
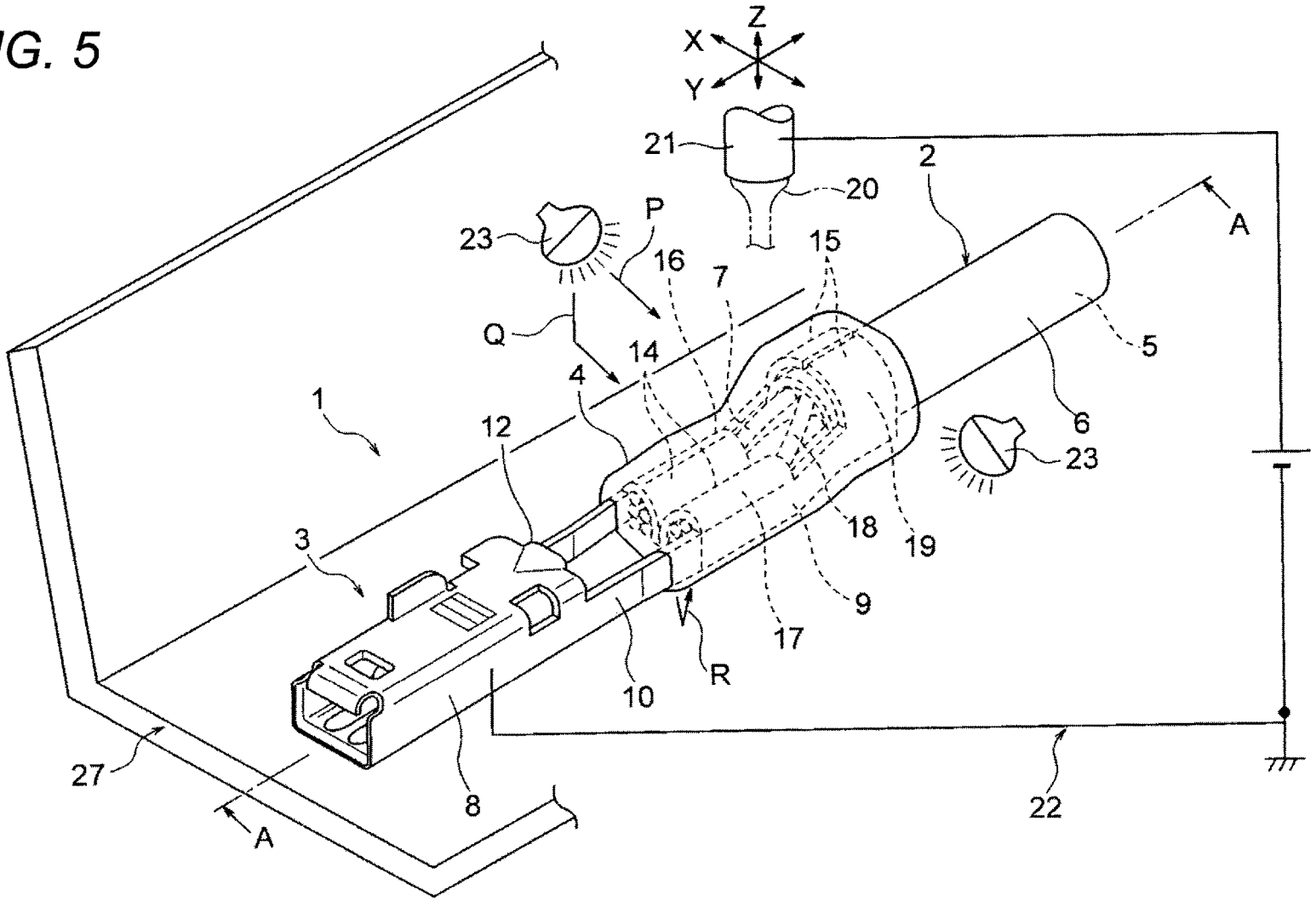
FIG. 5 is a perspective view showing a terminal with an electric wire, for explaining the manufacturing method according to an embodiment of the invention.
Figure 6:
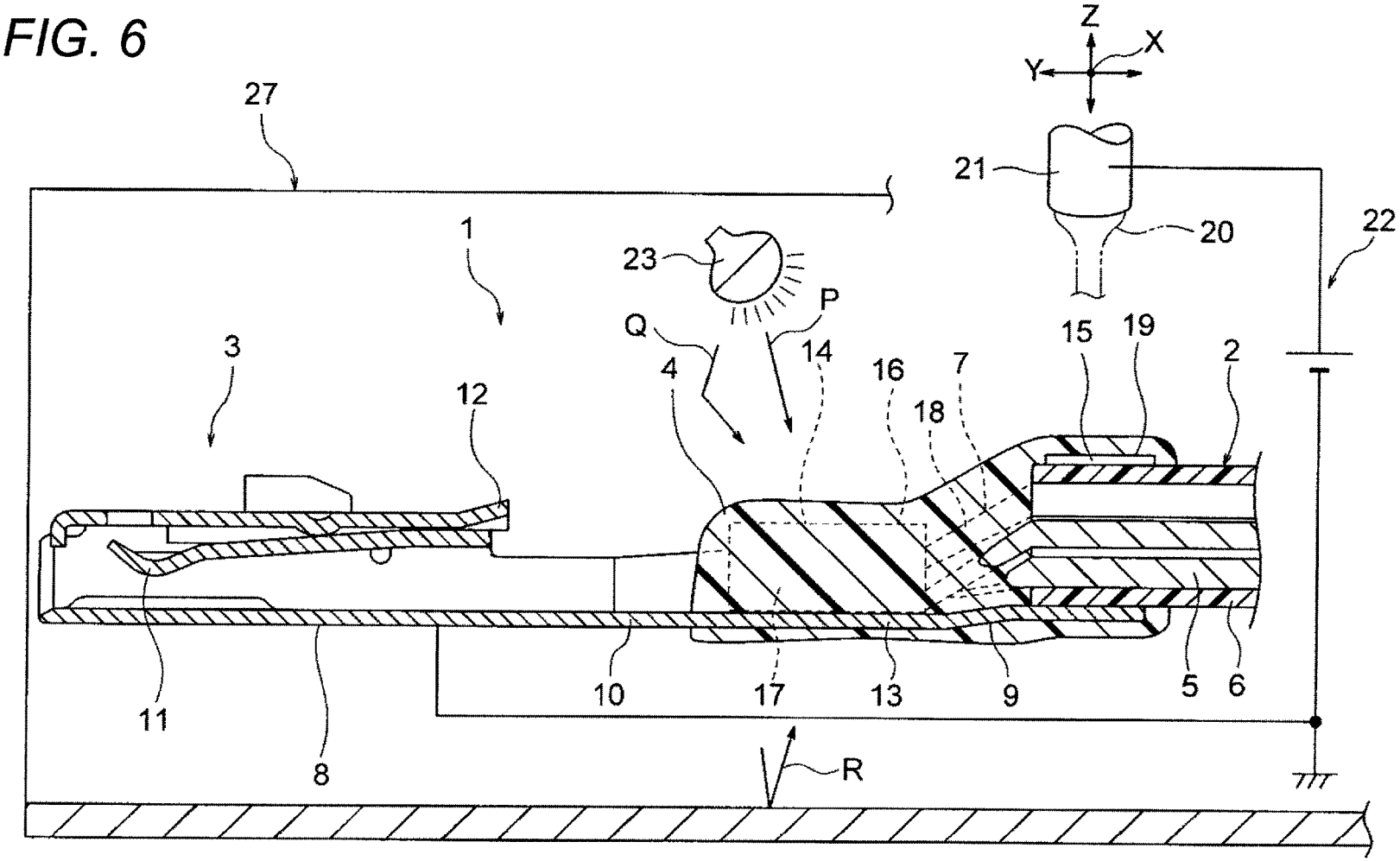
FIG. 6 is a sectional view taken on line A-A in FIG. 5.
Figure 7:
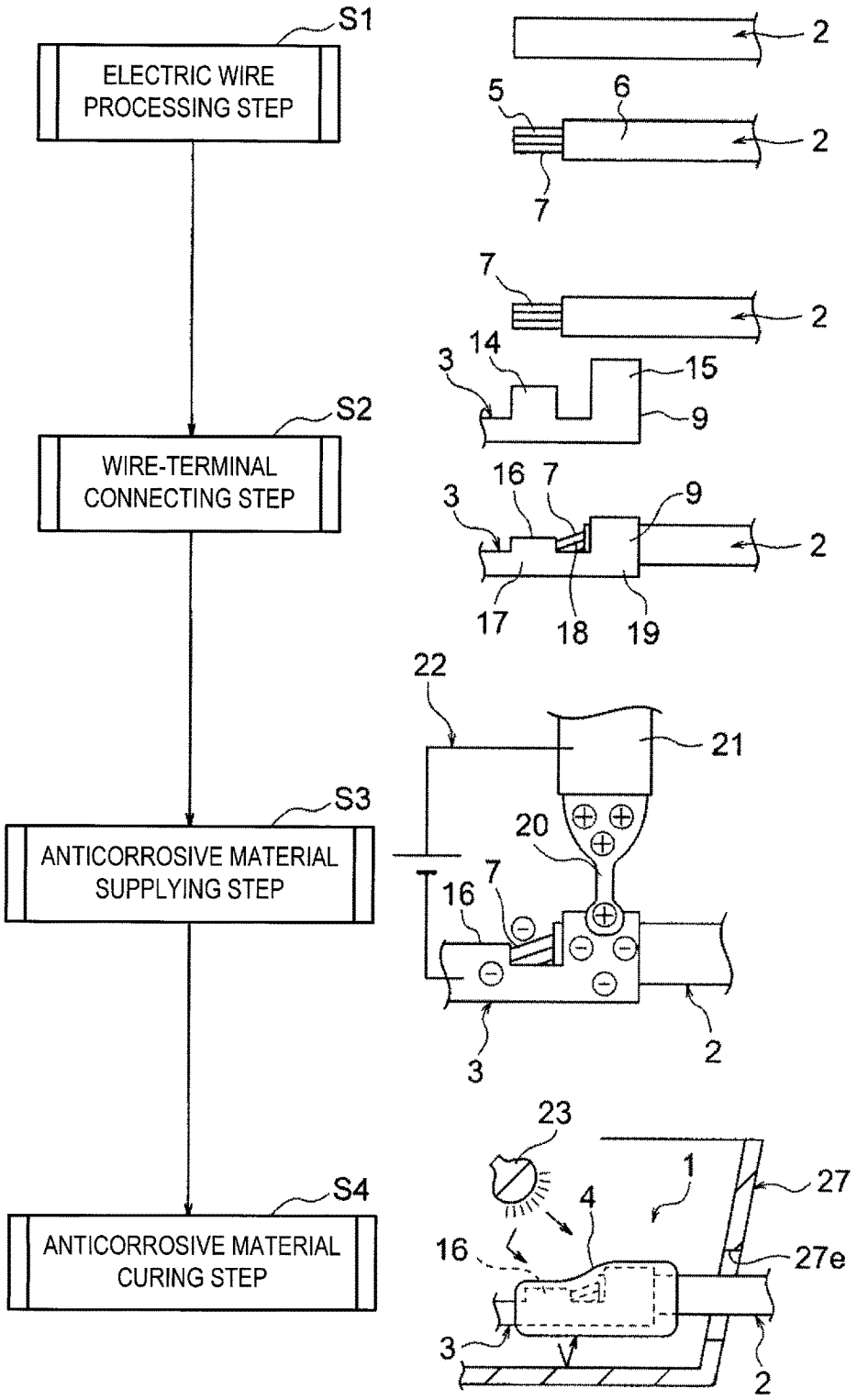
FIG. 7 is a diagram for explaining steps in the manufacturing method according to an embodiment of the invention.
Figure 8:
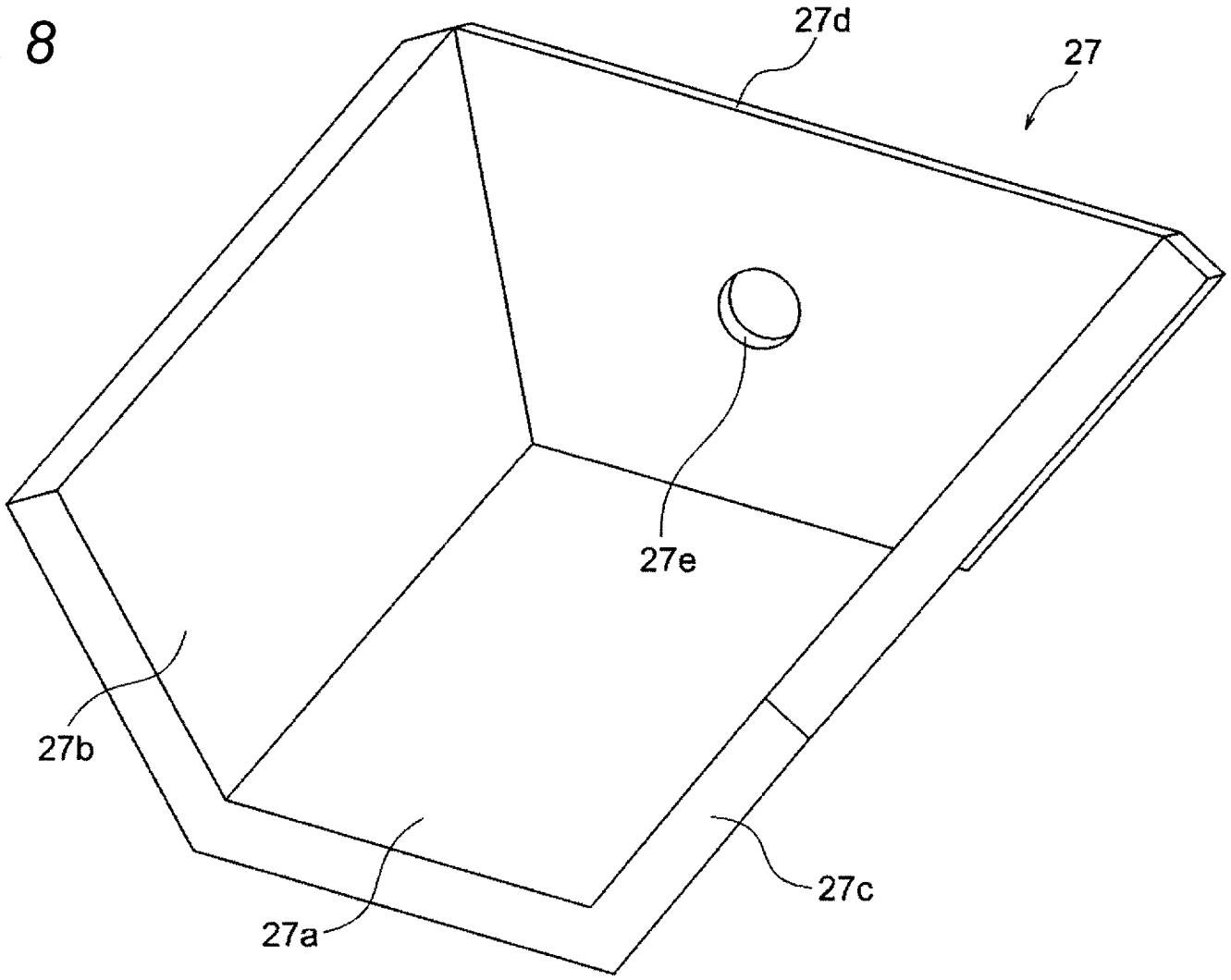
FIG. 8 is a perspective view showing a reflector for use in an anticorrosive material curing step in FIG. 7.
Figure 9A:
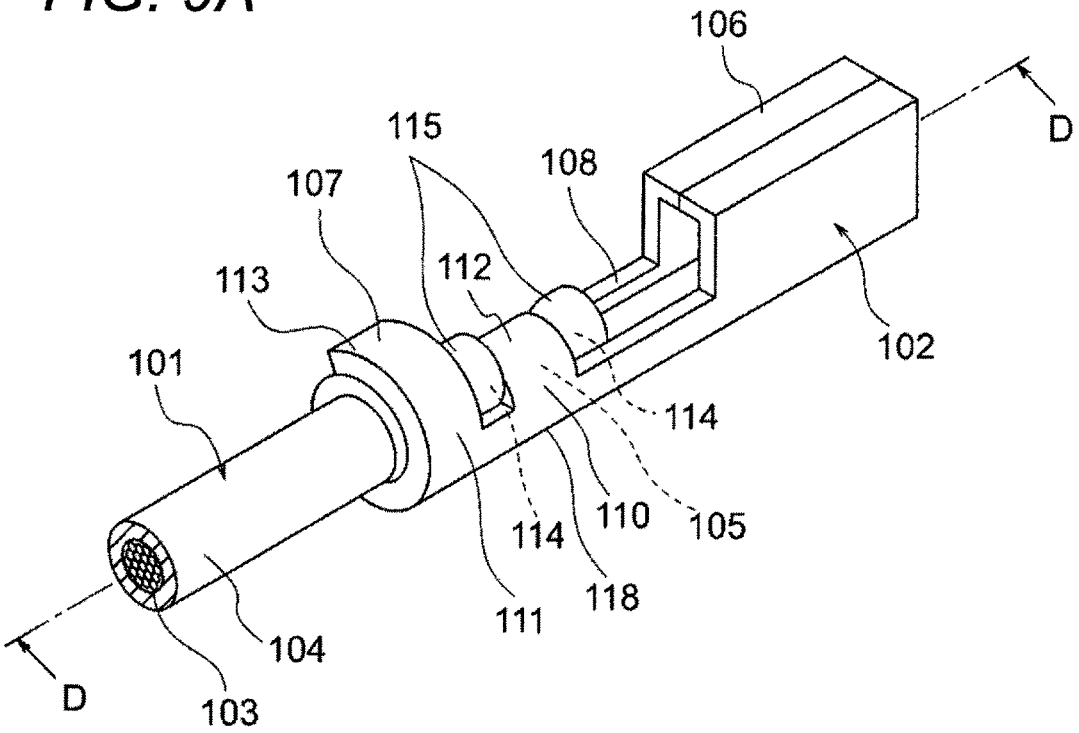
Figure 9B:
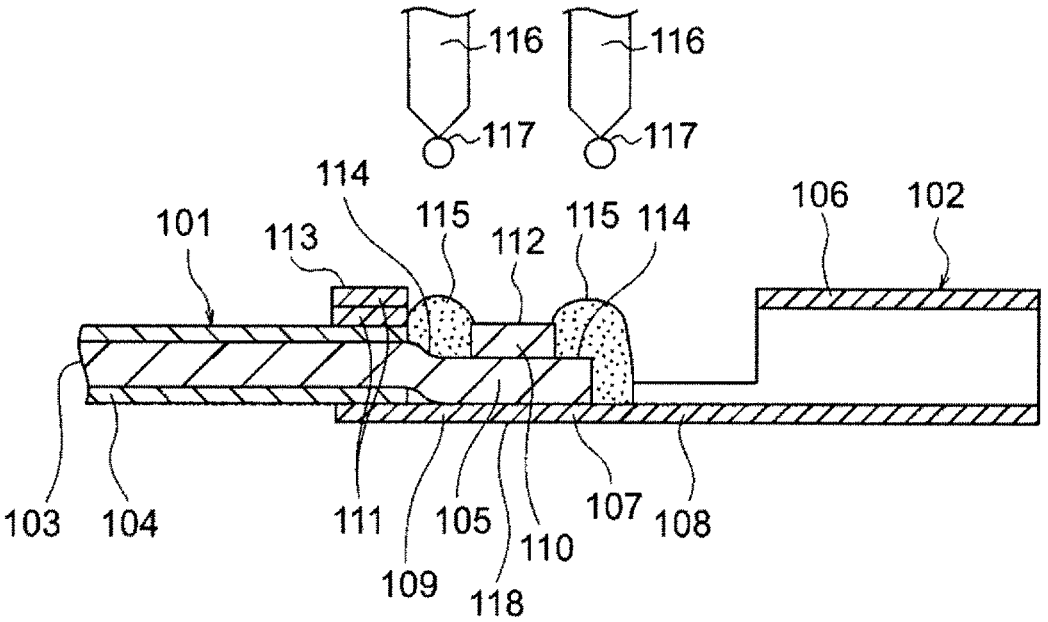

An embodiment will be described below with reference to the drawings. FIG. 1 is a perspective view showing a terminal with an electric wire, which is manufactured by a manufacturing method according to an embodiment of the invention. FIG. 2 is a sectional view taken on line A-A in FIG. 1. FIG. 3 is a perspective view showing a terminal with an electric wire, in which an anticorrosion portion has not been formed yet. FIG. 4 is a sectional view taken on line B-B in FIG. 3. FIG. 5 is a perspective view of a terminal with an electric wire, for explaining the manufacturing method according to an embodiment of the invention. FIG. 6 is a sectional view taken on line A-A in FIG. 5. FIG. 7 is a diagram for explaining steps in the manufacturing method according to an embodiment of the invention. FIG. 8 is a perspective view showing a reflector for use in an anticorrosive material curing step in FIG. 7.

<Configuration of Terminal 1 with Electric Wire>

In FIG. 1 and FIG. 2, the reference numeral 1 represents a terminal with an electric wire according to an embodiment of the invention. The terminal 1 with an electric wire is configured to include an aluminum electric wire 2 (electric wire), and a crimping terminal 3 (terminal fitting) disposed at a terminal end of the aluminum electric wire 2. In addition, the terminal 1 with an electric wire is configured to include an anticorrosion portion 4 (sealing portion, waterproof portion) in a part where different kinds of metals are connected with each other between the aluminum electric wire 2 and the crimping terminal 3. Incidentally, although the crimping terminal 3 is disposed at the terminal end of the aluminum electric wire 2 in the terminal 1 with an electric wire according to the embodiment, a terminal fitting having a suitable shape may be, for example, disposed in the middle of the aluminum electric wire 2.

<Configuration and Structure of Aluminum Electric Wire 2>

In FIG. 1 to FIG. 4, an aluminum electric wire that has a circular shape in section and that is soft enough to generate a reaction force to return to its original shape when a bending force is applied thereto is used as the aluminum electric wire 2. The aluminum electric wire 2 is configured to include a conductor 5 and a resin coating 6.

The conductor 5 is formed by twisting a plurality of strands (with no reference sign) each having a circular shape in section. The strands are made of aluminum or an aluminum alloy. That is, the conductor 5 is made of aluminum or an aluminum alloy. The conductor 5 has a predetermined conductor sectional area. A part having the conductor sectional area extends correspondingly to the electric wire length of the aluminum electric wire 2. The specific gravity of an aluminum material is 2.70 g/cm$^3$. The specific gravity of a copper material that will be described later is 8.96 g/cm$^3$. Therefore, the aluminum electric wire 2 is so light that fuel efficiency etc. can be improved effectively when the aluminum electric wire 2 is used as a long in-vehicle electric wire.

Incidentally, the aluminum material has a standard electrode potential of −1.676 V in an electrochemical reaction. On the other hand, the copper material that will be described later has a standard electrode potential of +0.340 V. Due to a large potential difference between those materials, a cell is formed out of aluminum, copper and an electrolytic aqueous solution when water enters and stays between the aluminum material and the copper material. Then, contact corrosion of different kinds of metals (galvanic corrosion, electric corrosion) occurs on the side serving as an anode of the cell, that is, on the conductor 5 side. For such a reason, it is a matter of course that the anticorrosion portion 4 is required for preventing the electric corrosion.

The resin coating 6 is a so-called insulator, which is formed into a circular shape in section by extrusion molding of an insulating resin material to the outside of the conductor 5. Various known kinds of resin materials may be used as the resin material. For example, the resin material may be selected suitably from polymer materials such as polyvinyl chloride resin, polyethylene resin, polypropylene resin, etc.

In the aluminum electric wire 2 configured thus, the resin coating 6 is removed at a terminal end thereof by a predetermined length to form a conductor exposed portion 7.

<Structure of Crimping Terminal 3>

In FIG. 1 to FIG. 4, the crimping terminal 3 is a female type terminal fitting, which is, for example, formed into the illustrated shape by pressing of a metal plate whose base material is made of copper or a copper alloy (it is noted that the crimping terminal 3 may be a male type terminal fitting). Incidentally, although not shown, plating is applied to the surface of the base material. The plating intervenes in a contact part of different kinds of metals between the copper material and the aluminum material. The crimping terminal 3 includes an electric contact portion 8, a crimping portion 9, and a coupling portion 10 coupling the electric contact portion 8 and the crimping portion 9 with each other.

The electric contact portion 8 is an electric connection part with a not-shown mating terminal fitting. The electric contact portion 8 is formed into a cylindrical shape that is rectangular in section. An insertion space in which a tab of the mating terminal fitting can be inserted is formed inside the electric contact portion 8. In addition, an elastic contact piece 11 is formed so that the electric contact piece 11 can make elastic contact with the tab when the tab is inserted. The reference numeral 12 in the electric contact portion 8 represents a locked portion that can be caught and locked to a lance of a not-shown connector housing.

The crimping portion 9 is an electric connection part with the aluminum electric wire 2. Since the terminal fitting according to the embodiment serves as the crimping terminal 3, the crimping portion 9 is formed in a part that can be connected to the aluminum electric wire 2 by crimping. Specifically, the crimping portion 9 is formed in a part including a mounting portion 13, a pair of conductor crimping pieces 14 and a pair of coating crimping pieces 15. The conductor exposed portion 7 of the aluminum electric wire 2 is mounted on the mounting portion 13. The conductor exposed portion 7 mounted on the mounting portion 13 is crimped by the conductor crimping pieces 14. The resin coating 6 near the conductor exposed portion 7 is crimped by the coating crimping pieces 15. Incidentally, the mounting portion 13 may be also referred to as a bottom plate. In addition, the conductor crimping pieces 14 may be also referred to as wire barrels. Further, the coating crimping pieces 15 may be also referred to as insulation barrels.

The pair of conductor crimping pieces 14 and the pair of coating crimping pieces 15 are disposed at a predetermined interval in an axial direction of the terminal. In addition, the pair of conductor crimping pieces 14 and the pair of coating crimping pieces 15 are formed into substantially V-shapes as their shapes before crimping. Incidentally, the pair of conductor crimping pieces 14 crimp the conductor exposed portion 7, and the pair of coating crimping pieces 15 crimp the resin coating 6. Therefore, those pieces are formed with different widths and different protruding lengths in accordance with a difference in shape or outer circumferential length between objects to be crimped by the pieces respectively.

When the conductor exposed portion 7 is crimped to the crimping portion 9 configured thus, a wire-terminal connection portion as represented by the reference numeral 16 is formed. The wire-terminal connection portion 16 is formed including a conductor crimping part 17 in which the conductor exposed portion 7 is crimped by the pair of conductor crimping pieces 14, a non-crimping part 18 around the conductor crimping part 17, and a coating crimping part 19 in which the resin coating 6 near the conductor exposed portion 7 is crimped by the pair of coating crimping pieces 15.

The coupling portion 10 is formed into a substantially gutter-like shape extending with a predetermined length in the axial direction of the terminal. The electric contact portion 8 is continuously connected to one end of the coupling portion 10 in the axial direction of the terminal. In addition, the crimping portion 9 is continuously connected to the other end of the coupling portion 10 in the axial direction of the terminal.

<Anticorrosion Portion 4>

In FIG. 1 and FIG. 2, the anticorrosion portion 4 is formed as a part that can watertightly cover the wire-terminal connection portion 16 in order to prevent electric corrosion. Specifically, on the assumption that the illustrated arrows are defined as upper/lower, left/right, and front/rear, the anticorrosion portion 4 is formed as a part covering the upper side of the crimping portion 9 (the upper side of the conductor crimping part 17 and the upper side of the non-crimping part 18), the lower side of the crimping portion 9 (the lower side of the mounting portion 13), the left and right sides of the crimping portion 9, the front side of the crimping portion 9 (the front side of the conductor crimping part 17), and the rear side of the coating crimping part 19. To say other words, the anticorrosion portion 4 is formed as a part covering the front and rear of the wire-terminal connection portion 16, and the whole circumference of the wire-terminal connection portion 16 around the axis of the terminal.

<Method for Manufacturing Terminal 1 with Electric Wire>

In FIG. 5 to FIG. 7, the terminal 1 with an electric wire is manufactured through the following steps. That is, the terminal 1 with an electric wire is manufactured through a sequence of an electric wire processing step S1, a wire-terminal connecting step S2, an anticorrosive material supplying step S3 (sealing material supplying step, waterproofing material supplying step), and an anticorrosive material curing step S4 (sealing material curing step, waterproofing material curing step). The anticorrosive material supplying step S3 and the anticorrosive material curing step S4 are steps (forming method) for forming the anticorrosion portion 4.

In the electric wire processing step S1, the conductor exposed portion 7 is formed at the terminal end of the aluminum electric wire 2. Specifically, the resin coating 6 is removed by a predetermined length to expose the conductor 5. Thus, the conductor exposed portion 7 is formed.

In the wire-terminal connecting step S2, the crimping portion 9 of the crimping terminal 3 is disposed in a position of the conductor exposed portion 7, and the wire-terminal connection portion 16 is then formed by crimping connection. In the crimping, pressing is performed by an anvil and a crimper of a crimping machine. That is, crimping is performed. When the conductor exposed portion 7 is crimped to the crimping portion 9, the conductor crimping part 17, the non-crimping part 18 and the coating crimping part 19 are formed.

In the anticorrosive material supplying step S3, the anticorrosive material 20 (sealing material, waterproofing material) is supplied to the wire-terminal connection portion 16. In the anticorrosive material supplying step S3, an anticorrosive material supplying apparatus having the following configuration is used. The anticorrosive material supplying apparatus is configured to include a dispenser (dispenser also using static electricity) having a metal nozzle 21, a voltage applying portion 22 for applying a voltage between the metal nozzle 21 and the crimping terminal 3, and a control portion for controlling the dispenser and the voltage applying portion 22.

A liquid ultraviolet-curing resin is used as the anticorrosive material 20. When a voltage is applied between the metal nozzle 21 and the crimping terminal 3, positive charges are induced on the liquid surface of the anticorrosive material 20. Incidentally, the voltage applied between the metal nozzle 21 and the crimping terminal 3 is about 3 kV in the embodiment. On the other hand, negative charges are induced on the crimping terminal 3 side.

When the voltage is applied between the metal nozzle 21 and the crimping terminal 3, the liquid interface of the anticorrosive material 20 is pulled in the direction of an electric line of force by an electrostatic force. That is, the anticorrosive material 20 that has been charged is attracted in a direction from the metal nozzle 21 toward the wire-terminal connection portion 16. When the anticorrosive material 20 is pulled (attracted), the anticorrosive material 20 comes into contact with the wire-terminal connection portion 16 without wetting-up from a tip portion of the metal nozzle 21. Specifically the anticorrosive material 20 is stretched continuously substantially like a string to a part where an electric field is concentrated, and the anticorrosive material 20 stretched thus comes into contact with the wire-terminal connection portion 16.

In the anticorrosive material supplying step S3, the metal nozzle 21 is moved in the directions of the arrows X, Y and Z in FIG. 5 and FIG. 6 when the anticorrosive material 20 is being supplied. The anticorrosive material 20 that has been charged is supplied. Accordingly, the charged anticorrosive material 20 is attracted to the wire-terminal connection portion 16 by an electrostatic force, and then supplied in a state where the anticorrosive material 20 can turn around the opposite side to a position from which the anticorrosive material 20 is supplied. That is, even when the anticorrosive material 20 is supplied from above, the anticorrosive material 20 can turn around the lower side of the wire-terminal connection portion 16 so as to be supplied to the whole circumference of the wire-terminal connection portion 16. Since an attractive force caused by the electrostatic force acts on the anticorrosive material 20 supplied to the whole circumference of the wire-terminal connection portion 16, the anticorrosive material 20 can stay at that place without dripping. In addition, the anticorrosive material 20 can permeate the strands of the conductor 5 in the non-crimping part 18 and stay therein.

In the anticorrosive material curing step S4, the anticorrosive material 20 supplied to the whole circumference of the wire-terminal connection portion 16 is irradiated with ultraviolet rays (UV light) and UV-cured. The manufacturing method according to an embodiment of the invention is characterized in that the anticorrosive material 20 made of liquid ultraviolet-curing resin is used, and a pair of UV lights 23 and a reflector 27 are used for surely curing the anticorrosive material 20. When the anticorrosive material 20 made of liquid ultraviolet-curing resin suffers energy due to irradiation with ultraviolet rays from the UV lights 23 directly and indirectly (the illustrated arrow P designates a state of direct irradiation with ultraviolet rays, and the arrows Q and R designate states of indirect irradiation with ultraviolet rays reflected by the reflector 27), the anticorrosive material 20 can be cured in a short time while keeping the above-described staying state. When the anticorrosive material 20 is cured, the anticorrosion portion 4 watertightly covering the wire-terminal connection portion 16 is completely formed. That is, the terminal 1 with an electric wire is completely manufactured.

The UV lights 23 are devices capable of radiating ultraviolet rays (UV light). In the embodiments, two UV lights 23 are provided (The number of UV lights 23 is an example. The number of UV lights 23 may be one if the reflection efficiency of the reflector 27 is high. On the contrary, the number of UV lights 23 may be three or more). In addition, the reflector 27 is a structure capable of reflecting the ultraviolet rays from the UV lights 23. The pair of UV lights 23 and the reflector 27 are disposed so that the ultraviolet rays can be radiated to the whole circumference of the wire-terminal connection portion 16 around the axis of the crimping terminal 3.

In FIG. 8 (in FIG. 5 to FIG. 8), the reflector 27 according to the embodiment includes a lower wall 27*a*, a left wall 27*b*, a right wall 27*c* and a rear wall 27*d*. The left wall 27*b* and the right wall 27*c* are provided obliquely erectly from opposite left and right side portions of the lower wall 27*a* respectively. The rear wall 27*d* is provided a little obliquely erectly from a rear portion of the lower wall 27*a*. The inner surfaces of those walls have a function of reflecting the ultraviolet rays. Incidentally, the reference sign 27*a* in the rear wall 27*d* represents a terminal insertion hole. Prior to the anticorrosive material supplying step S3 (see FIG. 7), the terminal insertion hole 27*e* is formed to be large enough to insert therein the crimping terminal 3 in which the wire-terminal connection portion 16 has been formed, and to be large enough to pull out therefrom the terminal 1 with an electric wire in which the anticorrosion portion 4 has been completely formed. The reflector 27 is not limited to the illustrated shape in the embodiment, but may be, for example, formed into a shape like a concave mirror.

<Summary of Terminal 1 with Electric Wire, and Effect of Manufacturing Method>

As has been described above with reference to FIG. 1 to FIG. 8, a terminal 1 with an electric wire is configured to include an aluminum electric wire 2 and a crimping terminal 3. The aluminum electric wire 2 is configured to include a conductor 5 made of aluminum or an aluminum alloy, and an insulating resin coating 6 covering the conductor 5. In the aluminum electric wire 2, the resin coating 6 is removed to form a conductor exposed portion 7 (electric wire processing step S1). On the other hand, the crimping terminal 3 includes a crimping portion 9 as a crimping part. A pair of conductor crimping pieces 14 and a pair of coating crimping pieces 15 are formed in the crimping portion 9. In the terminal 1 with an electric wire, the crimping portion 9 is crimped to the conductor exposed portion 7 so as to form an wire-terminal connection portion 16 (a wire-terminal connecting step S2). Then, an anticorrosion portion 4 is formed to cover the wire-terminal connection portion 16. The anticorrosion portion 4 is formed in such a manner that a voltage is applied between the crimping terminal 3 and a metal nozzle 21 and an anticorrosive material 20 that has been charged is supplied from the metal nozzle 21 so as to be attracted to the wire-terminal connection portion 16 (anticorrosive material supplying step S3). In addition, the anticorrosion portion 4 is formed in such a manner that the anticorrosive material 20 supplied to the wire-terminal connection portion 16 is UV-cured by irradiation with ultraviolet rays (anticorrosive material curing step S4). In order to be UV-cured, the anticorrosive material 20 is irradiated with ultraviolet rays directly from UV lights 23 and indirectly through a reflector 27.

According to the terminal 1 with an electric wire, the anticorrosive material 20 is attracted to the wire-terminal connection portion 16 due to an electrostatic force when the anticorrosion portion 4 is formed. In addition, an attractive force caused by the electrostatic force acts on the anticorrosive material 20 supplied to the wire-terminal connection portion 16, so that the anticorrosive material 20 can stay on the wire-terminal connection portion 16.

In addition, according to the terminal 1 with an electric wire, when the anticorrosion portion 4 is formed, the anticorrosive material 20 that has been charged is attracted by the electrostatic force so that the anticorrosive material 20 can turn around the opposite side to a position from which the anticorrosive material 20 is supplied. That is, the anticorrosive material 20 can be supplied to the whole circumference of the wire-terminal connection portion 16. The attractive force caused by the electrostatic force acts on the anticorrosive material 20 supplied to the whole circumference of the wire-terminal connection portion 16, so that the anticorrosive material 20 can stay at that place without dripping.

In addition, according to the terminal 1 with an electric wire, when the anticorrosion portion 4 is formed, the anticorrosive material 20 made of ultraviolet-curing resin is used. The attractive force caused by the electrostatic force acts on the anticorrosive material 20 so that the anticorrosive material 20 can stay on the wire-terminal connection portion 16. When the anticorrosive material 20 staying on the wire-terminal connection portion 16 is irradiated with ultraviolet rays directly from the UV lights 23 and indirectly through the reflector 27, the anticorrosive material 20 suffers energy due to the irradiation with the ultraviolet rays so that the anticorrosive material 20 can be cured in a short time while keeping the above-described staying state. According to an embodiment of the invention, even when there is a part in the shade of the UV lights 23, the part can be irradiated with ultraviolet rays indirectly through the reflector 27. Therefore, according to an embodiment of the invention, there is an effect that the anticorrosive material 20 can be cured surely.

It is a matter of course that various changes can be made on the invention without changing the scope of the invention.

What is claimed is:

1. A method for manufacturing a terminal with an electric wire operatively associated with an apparatus that includes a nozzle, a reflector and UV light, the method comprising:

forming a conductor exposed portion by removing a resin coating of an electric wire;

forming a wire-terminal connection portion by connecting a terminal fitting to a position of the conductor exposed portion;

providing the reflector;

placing the wire-terminal connection portion at a location relative to the reflector;

supplying a sealing material made of ultraviolet-curing resin from the nozzle to form a sealing portion covering the wire-terminal connection portion; and curing the sealing material by irradiation with ultraviolet rays from the UV light, wherein during supplying the sealing material, applying a voltage between the nozzle and the terminal fitting, supplying the sealing material that has been charged from the nozzle so as to be attracted to the wire-terminal connection portion, and keeping the sealing material so as to stay at the wire-terminal connection portion, and wherein during curing of the sealing material, reflecting the ultraviolet rays with the reflector toward the sealing material supplied to the wire-terminal connection portion in a state attracted to the wire-terminal connection portion and stayed at the wire-terminal connection portion.

2. The method for manufacturing a terminal with an electric wire according to claim 1, wherein during curing of the sealing material, disposing the UV light and the reflector such that the irradiation with ultraviolet rays is performed on a whole circumference of the wire-terminal connection portion around an axis of the terminal fitting.

* * * * *